US010918926B2

(12) United States Patent
Pennington

(10) Patent No.: US 10,918,926 B2
(45) Date of Patent: Feb. 16, 2021

(54) SYSTEM, METHOD AND APPARATUS FOR PHYSICAL TRAINING AND CONDITIONING

(75) Inventor: Mayfield Pennington, Pikeville, KY (US)

(73) Assignee: Elizabeth Christensen, Alexandria, VA (US)

( * ) Notice: Subject to any disclaimer, the term of this patent is extended or adjusted under 35 U.S.C. 154(b) by 0 days.

(21) Appl. No.: 13/242,522

(22) Filed: Sep. 23, 2011

(65) Prior Publication Data

US 2012/0295769 A1 Nov. 22, 2012

Related U.S. Application Data

(60) Provisional application No. 61/488,416, filed on May 20, 2011.

(51) Int. Cl.

| | |
|---|---|
| ***A63B 69/00*** | (2006.01) |
| ***A63B 69/20*** | (2006.01) |
| ***A63B 17/02*** | (2006.01) |
| ***A63B 69/34*** | (2006.01) |
| ***A63B 17/04*** | (2006.01) |
| ***A63B 21/055*** | (2006.01) |
| ***A63B 21/04*** | (2006.01) |
| ***A63B 23/04*** | (2006.01) |
| ***A63B 23/12*** | (2006.01) |
| ***A63B 22/02*** | (2006.01) |
| ***A63B 21/00*** | (2006.01) |

(52) U.S. Cl.

CPC ..... *A63B 69/0057* (2013.01); *A63B 17/02* (2013.01); *A63B 17/04* (2013.01); *A63B 21/0442* (2013.01); *A63B 21/0552* (2013.01); *A63B 21/4005* (2015.10); *A63B 21/4007* (2015.10); *A63B 21/4009* (2015.10); *A63B 21/4017* (2015.10); *A63B 22/0235* (2013.01); *A63B 23/047* (2013.01); *A63B 23/1218* (2013.01); *A63B 23/1227* (2013.01); *A63B 69/20* (2013.01); *A63B 69/205* (2013.01); *A63B 69/34* (2013.01)

(58) Field of Classification Search

CPC ..... A63B 21/1403; A63B 21/1415; A63B 21/1419; A63B 21/04; A63B 21/0407; A63B 21/0442; A63B 21/0552; A63B 21/0557; A63B 69/20–345; A63B 23/1218; A63B 21/072–0783

USPC ..... 482/69, 124, 28, 87, 96

See application file for complete search history.

(56) References Cited

U.S. PATENT DOCUMENTS

| | | | | | |
|---|---|---|---|---|---|
| 219,439 | A | * | 9/1879 | Blend | 601/23 |
| 1,646,818 | A | * | 10/1927 | Holland | 482/102 |
| 3,030,109 | A | * | 4/1962 | Albitz | 482/88 |
| 4,147,344 | A | * | 4/1979 | Lee | 482/129 |
| 4,569,401 | A | * | 2/1986 | Luck | 482/57 |
| 5,372,561 | A | * | 12/1994 | Lynch | 482/54 |
| 5,569,129 | A | * | 10/1996 | Seif-Naraghi et al. | 482/69 |
| 5,582,561 | A | * | 12/1996 | Gonzalez | 482/83 |
| 5,647,827 | A | | 7/1997 | Gutkowski et al. | |
| 5,662,560 | A | * | 9/1997 | Svendsen et al. | 482/69 |

(Continued)

*Primary Examiner* — Jennifer Robertson

(74) *Attorney, Agent, or Firm* — Maier & Maier, PLLC

(57) ABSTRACT

A training device, including a frame having an interior opening and a support, a piece of conditioning equipment supported on the frame by the support, a resistance harness coupled to the frame, the resistance harness has a portion attachable to a user, and a cardiovascular exercise machine within the interior opening of the frame.

14 Claims, 5 Drawing Sheets

(56) References Cited

U.S. PATENT DOCUMENTS

| | | | | |
|---|---|---|---|---|
| 5,667,461 | A * | 9/1997 | Hall | 482/69 |
| 5,782,639 | A * | 7/1998 | Beal | 434/29 |
| 6,146,315 | A * | 11/2000 | Schonenberger | 482/69 |
| 6,220,992 | B1 * | 4/2001 | Shafik | 482/83 |
| 6,273,844 | B1 * | 8/2001 | Kelsey et al. | 482/54 |
| 6,348,028 | B1 * | 2/2002 | Cragg | 482/148 |
| 6,530,867 | B2 * | 3/2003 | Schwendemann | 482/83 |
| 6,554,747 | B1 * | 4/2003 | Rempe | 482/38 |
| 7,458,919 | B2 * | 12/2008 | Giusti | 482/87 |
| 7,494,450 | B2 * | 2/2009 | Solomon | 482/69 |
| 7,513,853 | B1 * | 4/2009 | Russ | 482/51 |
| 7,534,200 | B1 * | 5/2009 | Martinez | 482/142 |
| 7,857,739 | B2 * | 12/2010 | Caldwell | 482/133 |
| 2002/0160889 | A1 * | 10/2002 | Lederman | 482/83 |
| 2005/0164847 | A1 * | 7/2005 | Giusti | 482/86 |
| 2008/0113852 | A1 | 5/2008 | Caldwell | |
| 2010/0227742 | A1 * | 9/2010 | Jutte | 482/87 |
| 2012/0246884 | A1 * | 10/2012 | Wilson | A63B 69/004 24/302 |

* cited by examiner

SYSTEM, METHOD AND APPARATUS FOR PHYSICAL TRAINING AND CONDITIONING

CROSS-REFERENCE TO RELATED APPLICATIONS

This application claims priority to U.S. Provisional Patent Application No. 61/488,416, filed May 20, 2011 and entitled SYSTEM, METHOD AND APPARATUS FOR PHYSICAL TRAINING AND CONDITIONING, the entire contents of which are hereby incorporated by reference.

BACKGROUND

Training and conditioning are often tedious, time-consuming tasks. Generally, a long list of separate exercises must be performed, one after another. Because these exercises must be completed one at a time, users are forced to concentrate on one muscle or muscle group while other muscle groups are left inactive. This often makes training and conditioning routines lengthy and monotonously repetitive.

In addition, training one muscle or muscle group at a time makes it difficult, or sometimes impossible, to develop certain skills. For instance, while punching bags are useful for developing endurance, the fact that both the bag and the user must remain stationary makes it difficult to develop other skills, such as coordination and timing.

SUMMARY

According to one exemplary embodiment, a system, method and apparatus for facilitating physical training and conditioning are disclosed. The apparatus can include a frame having an interior opening and at least one support means, at least one piece of conditioning equipment supported on the frame by the support means, at least one resistance harness coupled to the frame, wherein the at least one resistance harness has a portion thereof selectively attachable to a user, and a cardiovascular exercise machine disposed within the interior opening of the frame. The method can include exercising on a cardiovascular exercise machine disposed within the frame of a training device, engaging at least one piece of conditioning equipment coupled to the frame of the training device, and being subjected to a resistance coupled to the frame of the training device, wherein the resistance comprises forces acting opposite to the direction of the cardiovascular exercise machine.

BRIEF DESCRIPTION OF THE DRAWINGS

Advantages of embodiments of the present invention will be apparent from the following detailed description of the exemplary embodiments. The following detailed description should be considered in conjunction with the accompanying figures in which.

DETAILED DESCRIPTION

Aspects of the present invention are disclosed in the following description and related figures directed to specific embodiments of the invention. Those skilled in the art will recognize that alternate embodiments may be devised without departing from the spirit or the scope of the claims. Additionally, well-known elements of exemplary embodiments of the invention will not be described in detail or will be omitted so as not to obscure the relevant details of the invention.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage or mode of operation.

Generally referring to FIGS. 1-4, a method and apparatus for facilitating physical training and conditioning is disclosed. The method and apparatus can accomplish this facilitation by combining one or more distinct training tools, providing an integrated, comprehensive strength and timing development experience. The method, and apparatus can be used to train or condition for any desired sport or physical activity, for example boxing.

Figure 1:
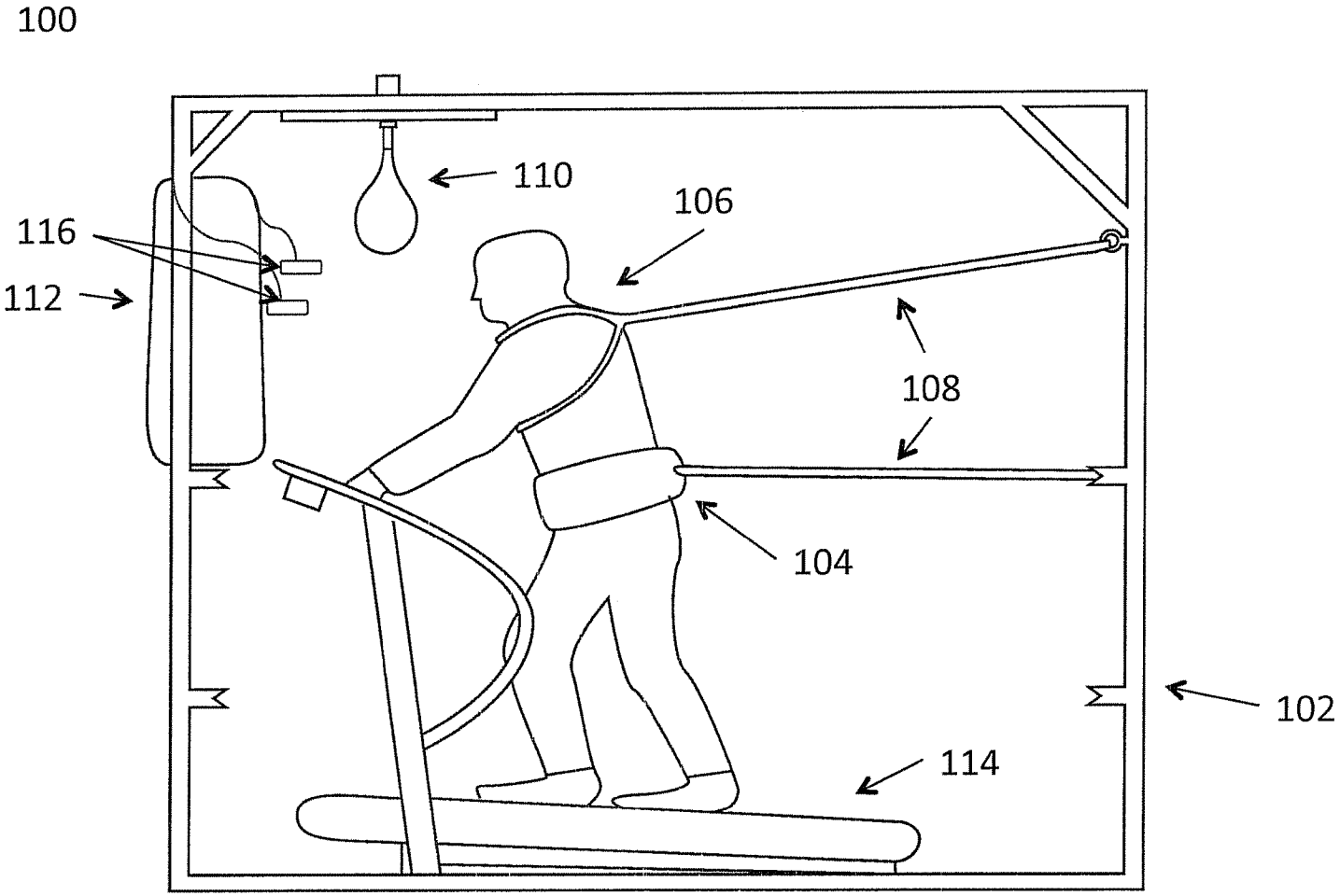
FIG. 1 is a cutaway view of an exemplary embodiment of a training and conditioning device.

FIG. 1 illustrates an exemplary embodiment of a training device 100. Training device 100 can include a frame 102. Frame 102 can be constructed of any desired material, for example wood, plastic, or metals such as steel or aluminum. Frame 102 can be solid, or it can be constructed of, for example, round, square, or rectangular tubing. Frame 102 can be any desired size, for example approximately ninety-six inches long, approximately eighty-six inches high, and approximately thirty-three inches wide. Frame 102 may be constructed in any shape, for example a rectangular cuboid. Additionally, frame 102 may include any number of supports, interior or exterior, such as triangular supports in the corner joints of frame 102 to provide frame 102 with stability and increase its weight bearing ability.

Still referring to the exemplary embodiment illustrated in FIG. 1, training device 100 can include one or more harnesses, such as waist harness 104, shoulder harness 106, or any other type of harness adapted to secure to a user, for example a chest harness or arm harnesses. Waist harness 104, shoulder harness 106, and any other harnesses can be attached to frame 102 using cords 108. Cords 108 can be constructed of rope, chain, or any type of elastic material, for example rubber, and can be removably attached to frame 102 using any desired attachment method. Training device 100 can also contain conditioning equipment, for example speed bag 110, heavy bag 112, or any other desired conditioning equipment. Training device 100 can be adapted for use with a treadmill 114, any other type of cardiovascular exercise machine, or any other type of exercise machine. Frame 102 can be sized to fit around or attach to treadmill 114, or any other type of exercise machine. Training device 100 may also include support handles 116 which may, for example, extend around heavy bag 112 and may allow the user to grab hold in order to provide a break from the resistance that cords 108 may supply.

Figure 2:
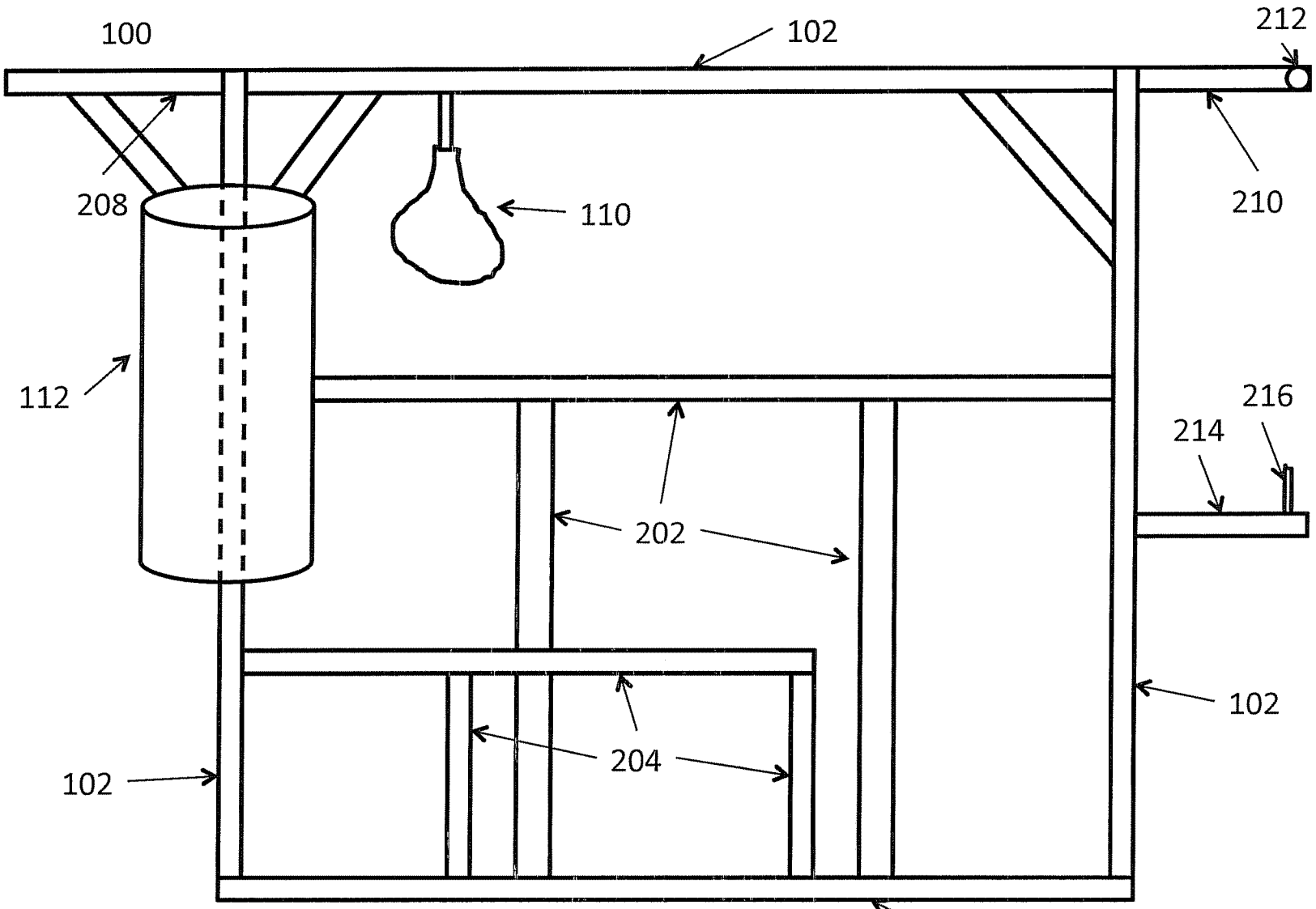
FIG. 2 is a side view of an exemplary embodiment of a training and conditioning device.

FIG. 2 illustrates an exemplary embodiment of training device 100. Training device 100 can include support arms 202 and 204. Support arms 202 and 204, similar to frame 102, may be constructed from any desired material, for example wood, plastic, or metals such as steel or aluminum. Support arms 202 and 204 can be solid, or can be constructed of, for example, round, square, or rectangular tubing. Support arms 202 and 204 can be any desired size. For example, support arm 204 may be constructed of hollow, square, aluminum bars, and may be approximately twenty-two and one-fourth inches high and approximately sixty-two and one-fourth inches long. Similarly, support arm 204 may, for example, be constructed of hollow, square, aluminum bars and may be approximately ninety-six inches long and approximately fifty inches high. Support arms 202 and 204 may include additional vertical supports. For example, support arm 202 may have one additional vertical support located approximately twenty-eight and one-half inches from the right edge of support arm 202, as viewed in FIG. 2, and support arm 204 may have two vertical supports located approximately twenty-one inches from each side of frame 102.

FIG. 2 further illustrates an exemplary embodiment which includes flanges 208 and 210. Similar to frame 102, both flanges 208 and 210 may be constructed of any desired material, in any shape, and may be permanently or removably affixed to frame 102. For example, flange 210 may be constructed from rectangular, aluminum tubing as a U-shaped bracket. One exemplary U-shaped bracket may measure approximately thirty three inches along its base and may have at least two arms measuring approximately twenty and one-half inches in length. Training device 100 may also incorporate additional training elements, such as pull-up bar 212 and dip bar 214. Pull-up bar 212 and dip bar 214 and may be constructed, in any desired shape, from any material, such as wood, plastics or metals and may be attached to training device 100 at any desired location.

Figure 3:
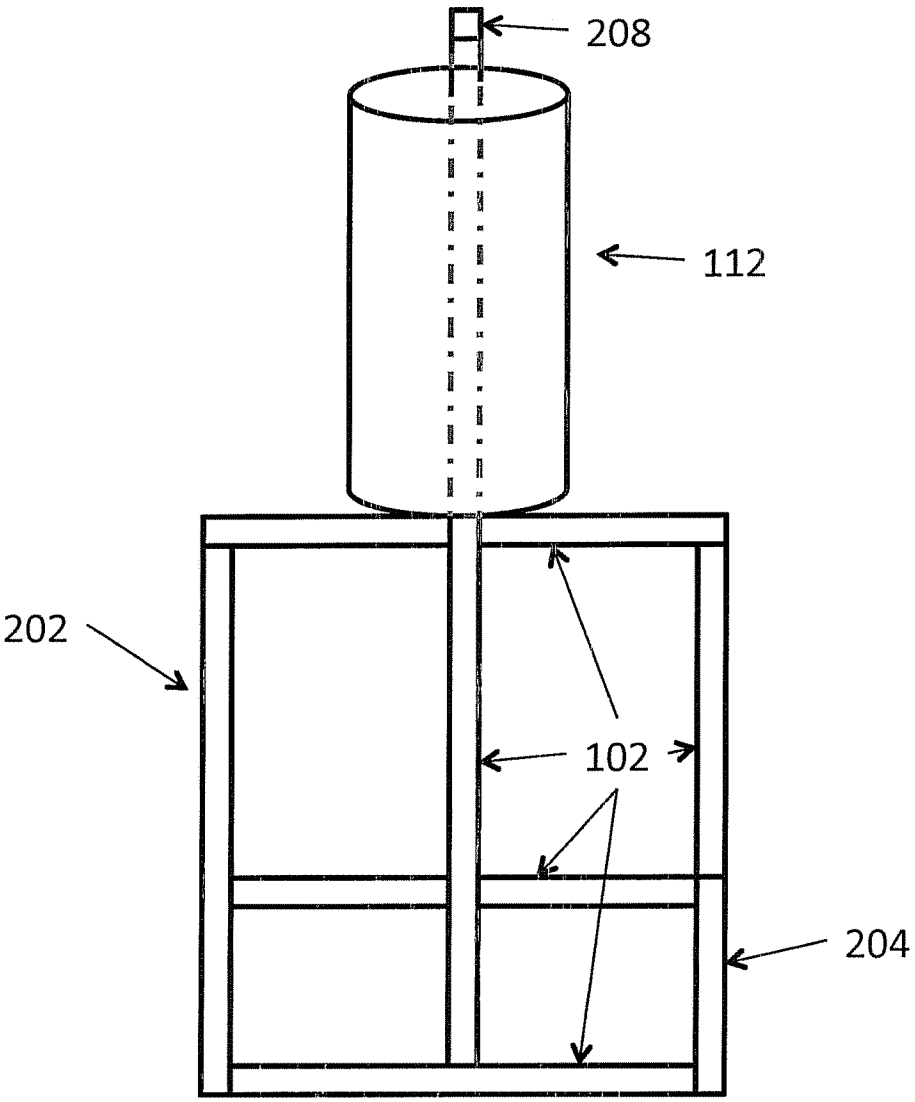
FIG. 3 is a front view of an exemplary embodiment of a training and conditioning device.
Figure 4:
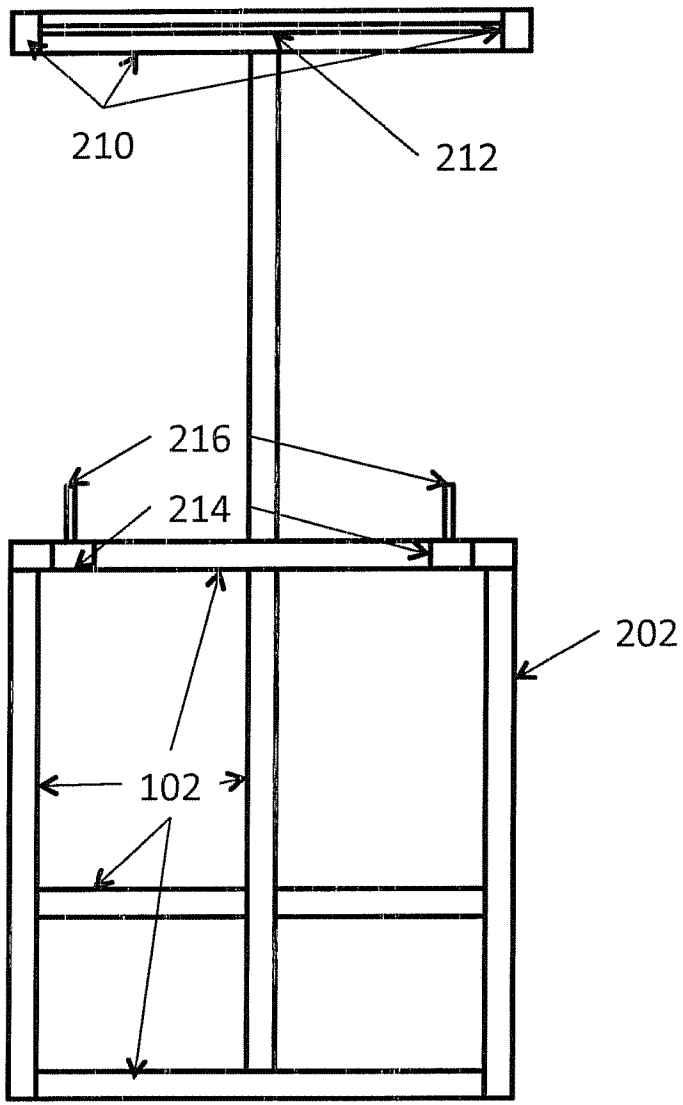
FIG. 4 is a rear view of an exemplary embodiment of a training and conditioning device.

Flanges 208 and 210 are further depicted in FIGS. 2-4. As depicted in FIGS. 2 and 4, flange 210 may be coupled to frame 102, such that both arms of flange 210 may extend outwards, perpendicularly, from the rear face of frame 102. In contrast, flange 208 may be a single hollow, square, steel bar measuring approximately twenty-four inches in length affixed to extend perpendicularly from the front face of frame 102. This exemplary configuration of flange 208 may be depicted in FIGS. 2 and 3. Flanges 208 and 210 may be removably affixed, or permanently affixed to frame 102.

FIG. 3 illustrates an exemplary front view of training device 100. Frame 102 may have a substantially rectangular appearance when viewed from the front with a protrusion extending from a point substantially midway along its top edge. Frame 102 may have support arms 202 and 204 and may further provide support means for training equipment, such as heavy bag 112, such that heavy bag 112 is disposed in front of the user while the user utilizes training device 100. It is envisioned that support arms 202 and 204 may be coupled to, or a part of frame 102, such that frame 102 may form a desired enclosure for training device 100 either in conjunction with, or regardless of, support arms 202 and 204. It is envisioned that support arms 202 and 204 may be either permanently or removably attached to frame 102. If coupled to frame 102, support arms 202 and 204 may be coupled exteriorly or interiorly to frame 102. Support arm 202 may be coupled to a first side of frame 102 and support arm 204 may, in turn, be coupled to the opposite side of frame 102, such that support arms 202 and 204 secure the user within training device 100 to the extent desirable.

Still referring to the exemplary embodiment depicted in FIG. 3, side arms 202 and 204 can assist a user to remain within training device 100 while using the device. Side arm 202 can be positioned lower than side arm 204 to facilitate a user's entry into and exit from training device 100. Alternatively, side arm 204 can be positioned lower than side arm 202 in order to facilitate egress to and from training device 100 on the opposite side. However, it is envisioned that side arm 202 and 204 can be any desired height. For example, side arm 202 can be approximately twenty-two and one-fourth inches tall, and side arm 204 can be approximately fifty inches tall. As mentioned, frame 102 may include any number of supports, such as horizontal supports extending along the entirety of the front face.

FIG. 4 depicts a rear view of an exemplary embodiment of training device 100. Training device 100 may include pull-up bar 210 and dip bar 214. Pull-up bar 212 may be an aluminum rod, coupled to both arms of flange 210 and extending therebetween. Dip bar 216 may, for example, be disposed at the rear of frame 102 and coupled to frame 102 approximately fifty inches off the ground. In this exemplary configuration, pull-up bar 212 may be positioned approximately thirty-six and one-half inches above the dip bar. Alternatively, pull-up bar 212 may be located approximately eighty-six and one-half inches from the ground. Further, dip bar 214 may include handles 216, which may be constructed in any desirable shape from any desirable material. For example, handles 216 may be aluminum rectangular cylinders, measuring approximately five inches in height and one approximately one inch in diameter. Handles 216 may be coupled to dip bar 214 and may be positioned approximately twenty-six and one-half inches from frame 102.

Figure 5:
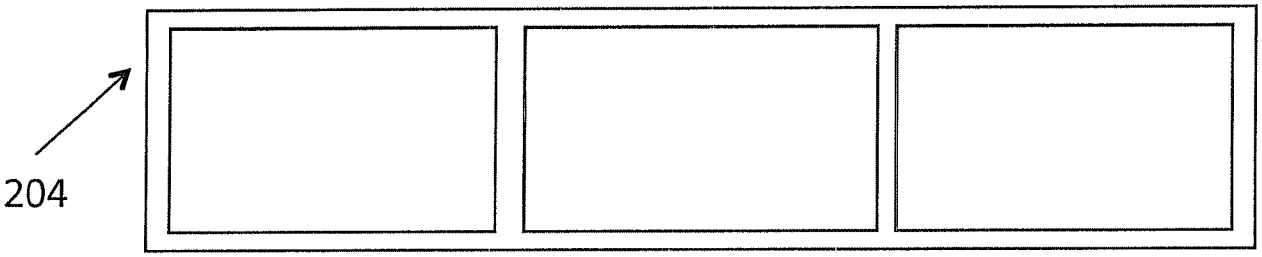
FIG. 5 is a side view of an exemplary embodiment of a training and conditioning device.
Figure 6:
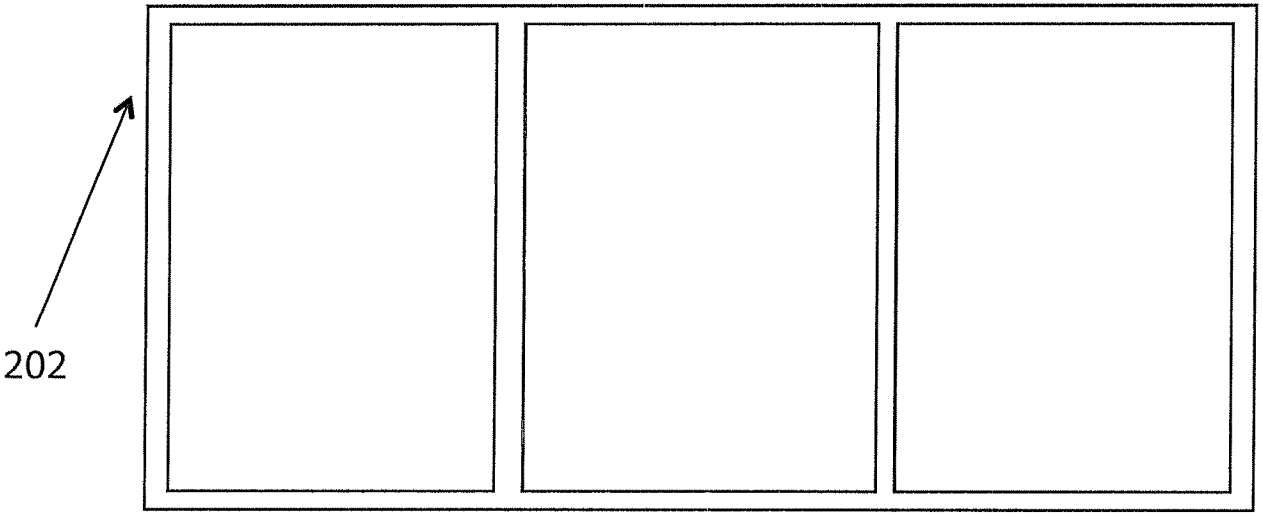
FIG. 6 is a side view of an exemplary embodiment of a training and conditioning device.

FIG. 5 illustrates a side view of an exemplary embodiment of frame 102, including side arm 204. FIG. 6 illustrates another side view of an exemplary embodiment of frame 102, including side arm 202.

A user can use training device 100 to perform a training and conditioning regimen. A user wearing waist harness 104 and shoulder harness 106 can use cords 108 to secure himself or herself to frame 102. The user can then activate treadmill 114 and use the resistance provided by cords 108 to engage in resistance running. While the user is resistance running he or she can simultaneously utilize any other equipment attached to frame 102, for example speed bag 110 and heavy bag 112, alone or in combination. Engaging in multiple exercises simultaneously can assist the user in building coordination and timing skills. The user can modify the equipment attached to frame 102 to accommodate any changes in skill level, for example by adding or changing the weight or size of speed bag 110 or heavy bag 112, or by changing cords 108 to provide more or less resistance as desired. If a user becomes fatigued, the user may grab support handles 116 in order to reduce the effect of the resistance and to stabilize him or herself while he or she recovers. In this way, training device 100 can provide a user-adjustable, comprehensive, time-saving, safe, and skill-building training and conditioning experience.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A training device comprising:

a rectangular cuboid frame having an interior opening and at least one support on a front side of the frame;

at least one piece of conditioning equipment supported on the frame by the support;

at least one second piece of conditioning equipment supported on a top portion of the frame, proximate the front side of the frame;

at least one resistance harness directly connected to a rear side of the frame, wherein the at least one resistance harness has a portion thereof selectively attachable to a user to exert a resistance force on the user in the direction of the rear side of the frame when the user is moving toward the front side of the frame;

at least one second resistance harness directly connected to the rear side of the frame and positioned below the at least one first resistance harness to exert a second resistance force on the user in the direction of the rear side of the frame when the user is moving toward the front side of the frame;

a cardiovascular exercise machine disposed within the interior opening of the frame; and a flange with two arms removably fixed to the frame, wherein the arms of the flange extend perpendicularly from the front side or the rear side of the frame, at least one support handle extending around at least one piece of conditioning equipment, wherein the support handle is configured to be grasped by the user when the at least one resistance harness is worn and is positioned to provide a force opposing the resistance force on the user when grasped;

wherein the at least one piece of conditioning equipment is positioned so as to facilitate use of the at least one piece of conditioning equipment and the at least one second piece of conditioning equipment in immediate succession, while simultaneously using the cardiovascular exercise machine, the at least one resistance harness, and the at least one second resistance harness.

2. The training device of claim 1, wherein the cardiovascular exercise machine is a treadmill.

3. The training device of claim 1, wherein the at least one piece of conditioning equipment is a heavy bag and the at least one second piece of conditioning equipment is a speed bag.

4. The training device of claim 1, wherein the at least one resistance harness is a shoulder harness.

5. The training device of claim 1, wherein the at least one second resistance harness is a waist harness.

6. The training device of claim 1, further comprising a pull-up bar coupled to the frame.

7. The training device of claim 1, further comprising a dip bar coupled to the frame.

8. The training device of claim 1, wherein the at least one support handle is disposed at the support and coupled to the frame so as to provide relief from the forces applied by the at least one resistance harness and the at least one second resistance harness.

9. The training device of claim 1, wherein the flange with two arms is removably fixed to the frame at a top end of the frame.

10. A boxing training apparatus comprising:

a rectangular cuboid frame having an interior opening and at least one support on a front side of the frame for at least one punching bag;

a cardiovascular exercise machine disposed within the interior opening of the frame;

a speed bag coupled to the frame along the top of the frame proximate the front side of the frame, such that a user may simultaneously utilize the cardiovascular exercise machine and the speed bag;

a heavy bag disposed at the front of the frame, supported by the support, such that a user may simultaneously use the cardiovascular exercise machine and the heavy bag;

at least one resistance harness directly connected to a rear of the frame, wherein the resistance harness has a portion thereof selectively attachable to a user to exert a resistance force on the user in the direction of the rear side of the frame when the user is moving toward the front side of the frame, at least one support handle extending around the heavy bag, wherein the support handle is configured to be grasped by the user when the at least one resistance harness is worn and is positioned to provide a force opposing the resistance force on the user when grasped; and a flange with two arms removably fixed to the frame, wherein the arms of the flange extend perpendicularly from the front side or the rear side of the frame.

11. The boxing training apparatus of claim 10, wherein the at least one resistance harness is one or more of a waist harness and a shoulder harness.

12. The boxing training apparatus of claim 10, further comprising a pull-up bar coupled to the frame.

13. The boxing training apparatus of claim 10, further comprising a dip bar coupled to the frame.

14. The boxing training apparatus of claim 10, wherein the flange with two arms is removably fixed to the frame at a top end of the frame.

* * * * *